US011811175B2

(12) United States Patent
Nakamura

(10) Patent No.: US 11,811,175 B2
(45) Date of Patent: Nov. 7, 2023

(54) ELECTRICAL CONNECTOR FITTED TO A MATCHING CONNECTOR AND CONNECTOR DEVICE INCLUDING THE ELECTRICAL CONNECTOR AND THE MATCHING CONNECTOR

(71) Applicant: I-PEX Inc., Kyoto (JP)

(72) Inventor: Hiroki Nakamura, Tokyo (JP)

( * ) Notice: Subject to any disclaimer, the term of this patent is extended or adjusted under 35 U.S.C. 154(b) by 265 days.

(21) Appl. No.: 17/324,523

(22) Filed: May 19, 2021

(65) Prior Publication Data

US 2021/0273386 A1 Sep. 2, 2021

Related U.S. Application Data

(63) Continuation of application No. PCT/JP2019/041387, filed on Oct. 21, 2019.

(30) Foreign Application Priority Data

Nov. 21, 2018 (JP) ..... 2018-218373

(51) Int. Cl.
*H01R 9/05* (2006.01)
*H01R 24/50* (2011.01)
(Continued)

(52) U.S. Cl.
CPC ..... *H01R 24/50* (2013.01); *H01R 12/75* (2013.01); *H01R 13/405* (2013.01); *H01R 2103/00* (2013.01)

(58) Field of Classification Search
CPC ..... H01R 24/50; H01R 12/75; H01R 13/405; H01R 2103/00; H01R 12/57; H01R 12/716
See application file for complete search history.

(56) References Cited

U.S. PATENT DOCUMENTS 7,891,979 B2 2/2011 Chien et al.
11,631,954 B2 * 4/2023 Nakagawa ..... H01R 13/40 439/63
(Continued)

FOREIGN PATENT DOCUMENTS

JP 2004-221055 8/2004
JP 2005-158656 6/2005
(Continued)

OTHER PUBLICATIONS

International Search Report dated Dec. 10, 2019 for PCT/JP2019/041387.
(Continued)

*Primary Examiner* — Abdullah A Riyami
*Assistant Examiner* — Nelson R. Burgos-Guntin
(74) *Attorney, Agent, or Firm* — SOEI PATENT & LAW FIRM

(57) ABSTRACT

A receptacle connector 10 includes a ground contact 11 including a fitting portion 11*a* that has a tubular shape and is to be fitted to a ground contact 101 of a plug connector 100; a signal contact 12 that is to be electrically connected to a signal contact 102 of the plug connector 100; and an insulating housing 13 that holds the ground contact 11 and the signal contact 12 in an insulated state. The signal contact 12 includes a central conductor 12*a*, and a board connection portion 12*b* that extends so as to lead out from the central conductor 12*a* to be connected to a signal terminal portion 201 of the board 200. The board connection portion 12*b* is accommodated in a region surrounded by the fitting portion 11*a*, and at least a part of the board connection portion 12*b* is exposed to an outside.

19 Claims, 31 Drawing Sheets

(51) Int. Cl.
*H01R 12/75* (2011.01)
*H01R 13/405* (2006.01)
*H01R 103/00* (2006.01)

(56) References Cited

U.S. PATENT DOCUMENTS

2004/0137764 A1 7/2004 Yamane
2006/0009075 A1 1/2006 Nagata et al.
2010/0304589 A1* 12/2010 Tuin ..... H01R 24/46 439/188
2011/0097930 A1 4/2011 Zuinen et al.
2012/0009817 A1 1/2012 Tagawa et al.
2012/0108103 A1* 5/2012 Ootani ..... H01R 24/545 439/578
2012/0322304 A1* 12/2012 Taguchi ..... H01R 13/501 439/582
2013/0040501 A1* 2/2013 Peng ..... H05K 1/115 439/660
2013/0102173 A1* 4/2013 Hashimoto ..... H01R 13/70 439/188
2013/0149897 A1* 6/2013 Takano ..... H01R 12/718 439/582
2013/0171876 A1* 7/2013 Funahashi ..... H01R 24/50 439/620.03
2013/0224992 A1* 8/2013 Hirakawa ..... H01R 9/05 439/578
2013/0244486 A1* 9/2013 Ohsaka ..... H01R 13/60 439/581
2013/0280954 A1* 10/2013 Ohsaka ..... H01R 24/50 439/578
2014/0206228 A1 7/2014 Kenzaki et al.
2015/0222062 A1* 8/2015 Sloey ..... H01R 13/213 439/578
2016/0365684 A1* 12/2016 Li ..... H05K 1/116
2017/0346209 A1* 11/2017 Hashimoto ..... H01R 24/40
2018/0048100 A1* 2/2018 Moilanen ..... H01R 43/26
2018/0069335 A1* 3/2018 Hashimoto ..... H01R 12/712
2018/0090891 A1* 3/2018 Schroll ..... H01R 24/545
2019/0115692 A1 4/2019 Tanaka et al.
2021/0242631 A1* 8/2021 Nakagawa ..... H01R 12/57
2021/0265790 A1* 8/2021 Nakagawa ..... H01R 13/6585
2022/0006245 A1* 1/2022 Nakamura ..... H01R 9/0512
2022/0271482 A1* 8/2022 Birch ..... H01R 24/50
2022/0388458 A1* 12/2022 Wang ..... H01R 13/6593
2022/0393409 A1* 12/2022 An ..... H01R 9/0515
2023/0008374 A1* 1/2023 Owaki ..... H01R 12/716
2023/0020293 A1* 1/2023 McCarron ..... H01R 24/50
2023/0025789 A1* 1/2023 Ito ..... H01R 12/716
2023/0068741 A1* 3/2023 Sugiura ..... H01R 4/28
2023/0100478 A1* 3/2023 Jung ..... H01R 12/7052 439/83

FOREIGN PATENT DOCUMENTS

JP 2006-049276 2/2006
JP 5024449 9/2012
JP 2013-191341 9/2013
JP 2015-207350 11/2015
JP 2017-076592 4/2017
JP 2017-212098 11/2017
JP 2018-045938 3/2018
TW 201036288 10/2010
WO 2013/046829 4/2013
WO 2017/212862 12/2017
WO 2018/074227 4/2018

OTHER PUBLICATIONS

International Preliminary Report on Patentability with Written Opinion dated Jun. 3, 2021 for PCT/JP2019/041387.

* cited by examiner

ELECTRICAL CONNECTOR FITTED TO A MATCHING CONNECTOR AND CONNECTOR DEVICE INCLUDING THE ELECTRICAL CONNECTOR AND THE MATCHING CONNECTOR

CROSS-REFERENCE TO RELATED APPLICATION

This application is a continuation application of PCT Application No. PCT/JP2019/041387, filed Oct. 21, 2019, the entire contents of which are incorporated herein by reference.

BACKGROUND

A connector device has been known in which a plug connector connected to a signal transmission member and a receptacle connector mounted on a board are fitted to each other to electrically connect the signal transmission member and an electrical circuit of the board (for example, refer to Patent Literature 1: Japanese Patent No. 5024449). The receptacle connector of Patent Literature 1 includes an outer conductor that engages with a tubular conductor of the plug connector; an inner conductor that comes into contact with a conductor of the plug connector inside the outer conductor; and an insulator.

Here, in the receptacle connector described in Patent Literature 1, the inner conductor includes a lead-out portion that leads out to the outside (direction of the outer conductor) to be able to come into contact with a terminal of the board. The lead-out portion leads out to the outside from the outer conductor. In such a configuration, in a state where the plug connector and the receptacle connector are fitted to each other, the conductor (outer conductor) of the plug connector and the lead-out portion of the receptacle connector are close to each other. Accordingly, electromagnetic coupling is likely to occur between the outer conductor of the plug connector and the lead-out portion of the receptacle connector, and the leakage of an electromagnetic field occurs, so that the insertion loss between the plug connector and the receptacle connector is increased.

SUMMARY

According to one aspect of the present disclosure, there is provided an electrical connector that is mounted on a board, the connector including: a first contact that has a tubular shape and is to be fitted to a ground contact of a mating connector; a second contact that is to be electrically connected to a signal contact of the mating connector; and a first insulating housing that holds the first contact and the second contact in an insulated state. The second contact includes a central conductor that comes into contact with the signal contact of the mating connector, and a board connection portion that extends so as to lead out from the central conductor to be connected to a terminal portion of the board. The board connection portion is accommodated in a region surrounded by the first contact, and comprises an exposed portion which is at least a part of the board connection portion and is exposed to an outside.

In the electrical connector according to one aspect of the present disclosure, the board connection portion which extends so as to lead out from the central conductor to be connected to the terminal portion of the board is accommodated in the region surrounded by the first contact that has a tubular shape and is to be fitted to the ground contact of the mating connector. Accordingly, in a state where the electrical connector of the present disclosure is fitted to the mating connector, the board connection portion connected to the central conductor is disposed at a position separated from the ground contact of the mating connector. Therefore, a configuration is realized in which electromagnetic coupling between the ground contact of the mating connector and the board connection portion is unlikely to occur, so that the insertion loss between the electrical connector and the mating connector can be suppressed. Further, in the electrical connector according to one aspect of the present disclosure, at least a part of the board connection portion is exposed to the outside. Accordingly, as in the electrical connector according to one aspect of the present disclosure, even when the configuration is adopted in which the board connection portion is accommodated in the region surrounded by the first contact (namely, the lead-out length is small), the position of the board connection portion can be easily observed.

The board connection portion may be disposed such that the exposed portion is visible when viewed in a Z direction, and the Z direction is a direction of fitting the electrical connector to the mating connector and is a direction from the mating connector toward the board. Accordingly, when the electrical connector is mounted on the board and when the mating connector is fitted to the electrical connector, the position of the board connection portion can be easily and reliably observed.

The exposed portion may be a tip portion of the board connection portion in an X direction, and the X direction is an extending direction of the board connection portion from the central conductor toward the terminal portion of the board.

The first insulating housing may comprise a cutout portion which exposes the exposed portion to the outside. Since such a configuration is adopted, while the first insulating housing provides reliable insulation between the first contact and the second contact, only a portion required to expose the board connection portion is cut out in the first insulating housing to be able to reliably expose a part of the board connection portion.

The cutout portion may be formed such that a region of contact with the terminal portion on the board connection portion is exposed to the outside. Accordingly, the location of contact between the board connection portion and the terminal portion is reliably visible.

The first insulating housing may not cut out in a first region that is closer to the central conductor than the exposed portion of the board connection portion in an X direction, the X direction is an extending direction of the board connection portion from the central conductor toward the terminal portion of the board, and the first insulating housing is cut out in a second region that is not closer to the central conductor than the exposed portion of the board connection portion in the X direction.

At least a part of the first insulating housing may not cut out in a region in the second region located outside both end portions of the exposed portion in a Y direction, and the Y direction is a direction crossing the X direction.

A length in a Y direction of the cutout portion may be longer than a length in the Y direction of the exposed portion, and the Y direction is a direction crossing an X direction and the X direction is an extending direction of the board connection portion from the central conductor toward the terminal portion of the board.

A length in a Y direction of the cutout portion may be longer than a length in the Y direction of the terminal portion of the board, and the Y direction is a direction crossing an X direction and the X direction is an extending direction of the board connection portion from the central conductor toward the terminal portion of the board.

The first insulating housing may be provided at least in a first region that is closer to the central conductor than the exposed portion of the board connection portion in an X direction, the X direction is an extending direction of the board connection portion from the central conductor toward the terminal portion of the board, and the first insulating housing is not provided in a second region that is not closer to the central conductor than the exposed portion of the board connection portion in the X direction.

The first insulating housing may have a circular shape including a major segment.

The second region may have a circular shape including a minor segment.

According to one aspect of the present disclosure, there is provided a connector device including a first connector mounted on a board; and a second connector that is connected to a signal transmission member and is fitted to the first connector. The first connector includes a first contact that is a ground contact having a tubular shape, a second contact that is a signal contact, and a first insulating housing that holds the first contact and the second contact in an insulated state. The second connector includes a third contact that has a tubular shape and is fitted to the first contact, a fourth contact that is electrically connected to the second contact, and a second insulating housing that holds the third contact and the fourth contact in an insulated state. The second contact includes a central conductor that comes into contact with the fourth contact, and a board connection portion that extends so as to lead out from the central conductor to be connected to a terminal portion of the board. In a state where the first connector and the second connector are fitted to each other, the board connection portion is accommodated in a region surrounded by the third contact, and in a state where the first connector and the second connector are not fitted to each other, at least a part of the board connection portion is exposed to an outside.

At least a part of the board connection portion may not be accommodated in a region surrounded by the first contact of the first connector, and the part of the board connection portion extends to an outside of the first contact.

An outer end of the third contact of the second connector may be disposed outside an outer end of the first contact of the first connector in an X direction, and the X direction is an extending direction of the board connection portion from the central conductor toward the terminal portion of the board, and a tip of the board connection portion is located between the outer end of the first contact of the first connector in the X direction and the outer end of the third contact of the second connector in the X direction.

According to one aspect of the present disclosure, there is provided an electrical connector configured to be connected to a signal transmission member and fitted to mating connector mounted on a board, the connector including a third contact configured to have a tubular shape and be fitted to a first contact of the mating connector; a fourth contact configured to be electrically connected to a second contact of the mating connector; and a second insulating housing configured to hold the third contact and the fourth contact in an insulated state, in a state where the connector and the mating connector are fitted to each other, a board connection portion of the mating connector is accommodated in a region surrounded by the third contact of the connector, and the mating connector comprises the board connection portion configured to extend so as to lead out from a central conductor of the mating connector to be connected to a terminal portion of the board.

DETAILED DESCRIPTION

Since an example according to the present disclosure to be described below is provided as an example to describe the present disclosure, the present disclosure should not be limited to the following contents. In the following description, the same reference signs are used for the same components or components having the same function, and duplicated descriptions will be omitted.

[Overview of Connector Device]

Figure 1:
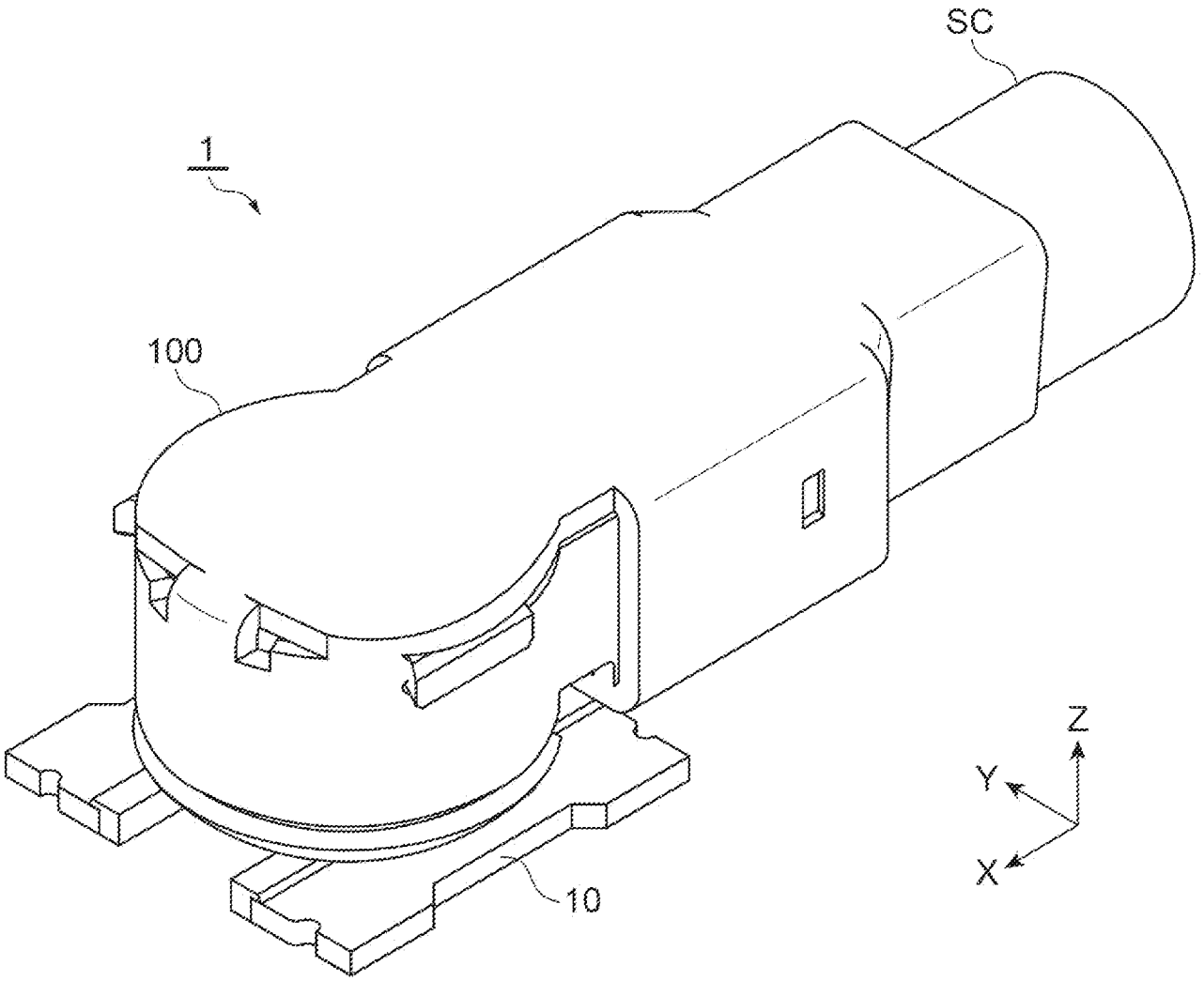
FIG. 1 is a perspective view of a connector device according to an example of the present disclosure.
Figure 2:
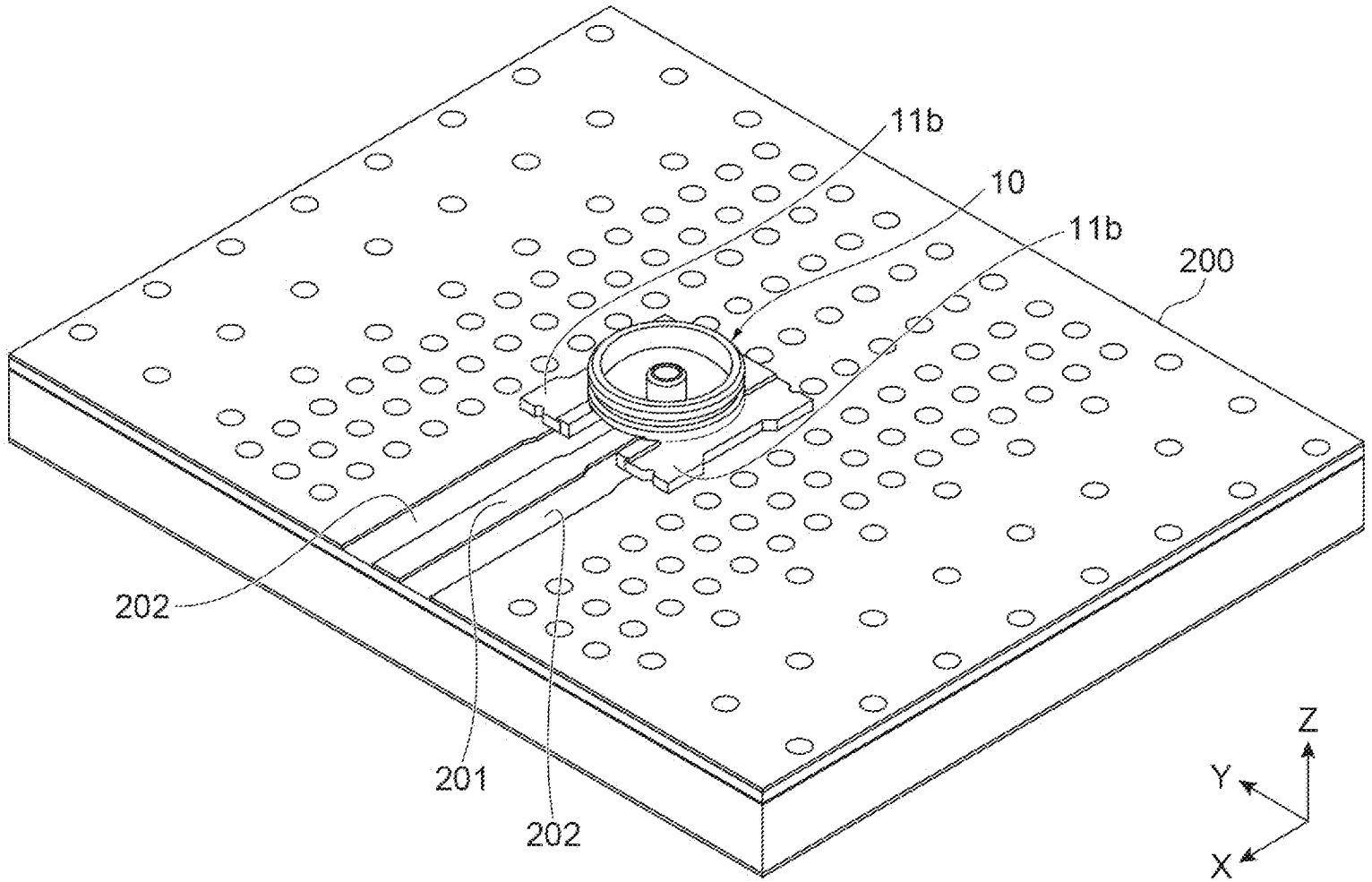
FIG. 2 is a perspective view of a receptacle connector mounted on a printed wiring board.

An overview of a connector device 1 will be described with reference to FIGS. 1 and 2. As illustrated in FIG. 1, the connector device 1 includes a receptacle connector 10 (electrical connector, first connector) and a plug connector 100 (mating connector, second connector). The receptacle connector 10 is mounted on a board 200 (refer to FIG. 2), for example, by soldering or the like. The plug connector 100 is connected to a coaxial cable SC (signal transmission member) and is fitted to the receptacle connector 10. In the connector device 1, the plug connector 100 attached to a terminal portion of the coaxial cable SC is fitted to the receptacle connector 10 mounted on the board 200 to electrically connect the coaxial cable SC and an electrical circuit of the board 200. Incidentally, the board 200 is, for example, a printed wiring board, but is not limited thereto. In addition, instead of the coaxial cable SC, other signal transmission members which transmit signals of various electronic devices may be used.

Incidentally, in the following description, a direction of fitting of the receptacle connector 10 and the plug connector 100 in the connector device 1 may be described as a "Z direction", an axial direction of the coaxial cable SC in the state of fitting may be described as an "X direction", and a direction orthogonal to the Z direction and the X direction may be described as a "Y direction". In addition, regarding the Z direction, for example, a plug connector 100 side in the state illustrated in FIG. 1 may be described as "up", and a receptacle connector 10 side may be described as "down". In addition, regarding the X direction, an end portion side of the coaxial cable SC, to which the plug connector 100 is attached, may be described as "front", and an opposite end portion side may be described as "rear".

[Receptacle Connector]

Figure 3A:
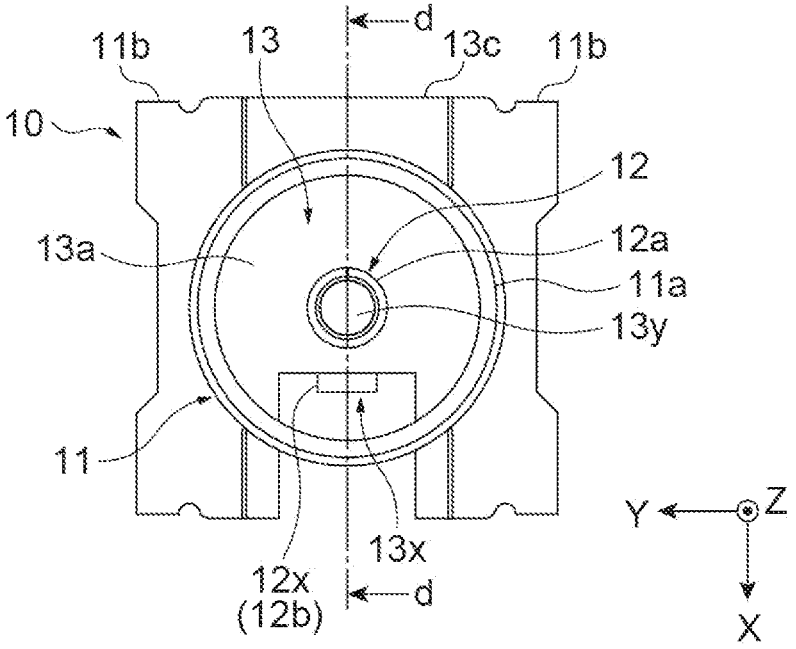
FIG. 3A is a plan view of the receptacle connector.
Figure 3B:
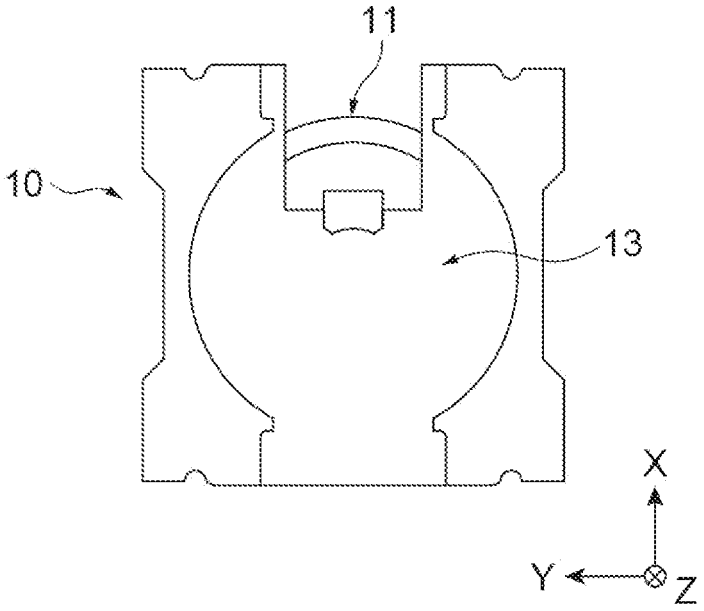
FIG. 3B is a bottom view of the receptacle connector.
Figure 3C:
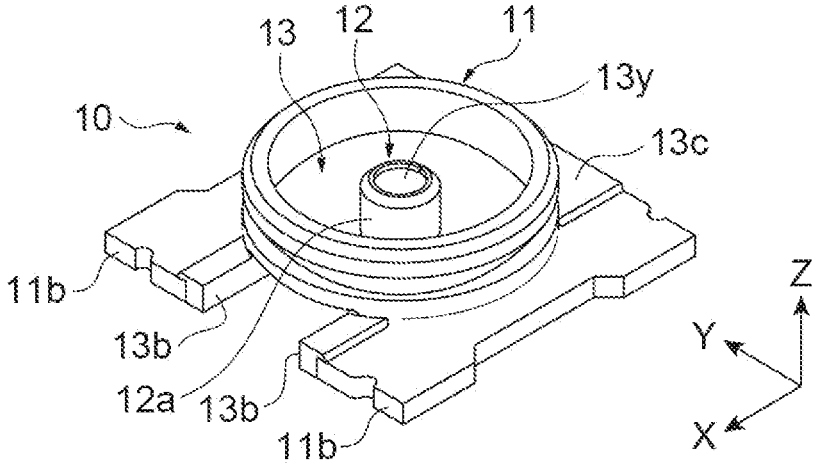
FIG. 3C is a perspective view of the receptacle connector.
Figure 3D:
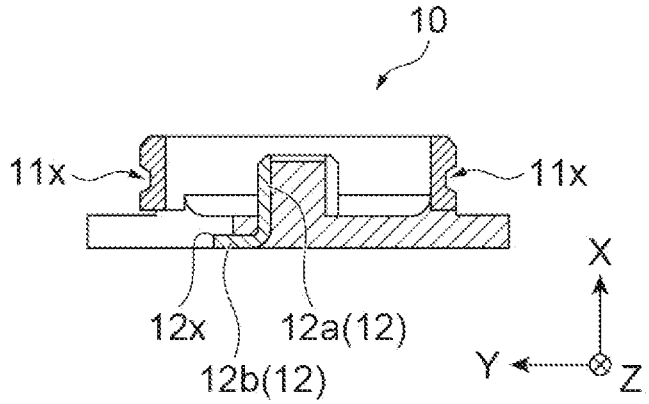
FIG. 3D is a cross-sectional view taken along line d-d in FIG. 3A.

Next, the receptacle connector 10 will be described in detail with reference to FIGS. 3A to 7F. The receptacle connector 10 is mounted on the board 200 (refer to FIG. 2), and is to be fitted to the plug connector 100 (refer to FIG. 1) attached to the coaxial cable SC. As illustrated in FIGS. 3A to 3C, the receptacle connector 10 includes a ground contact 11 (first contact); a signal contact 12 (second contact); and an insulating housing 13 (first insulating housing).

(Ground Contact)

Figure 4A:
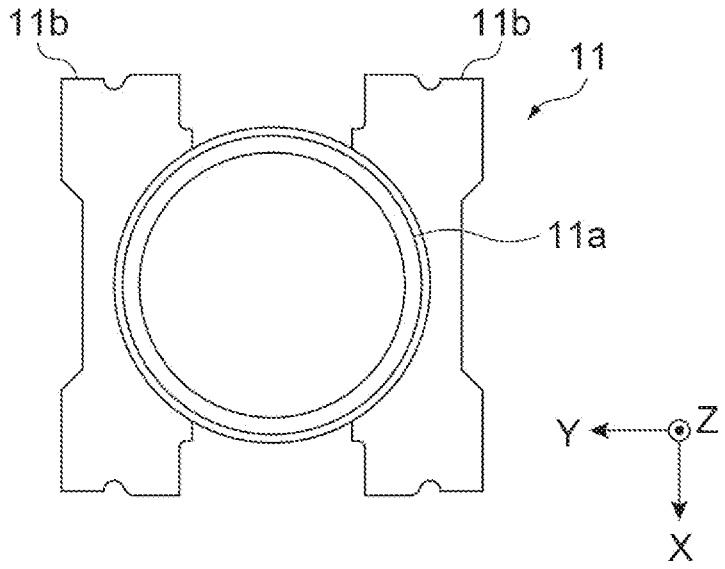
FIG. 4A is a plan view of a ground contact of the receptacle connector.
Figure 4B:
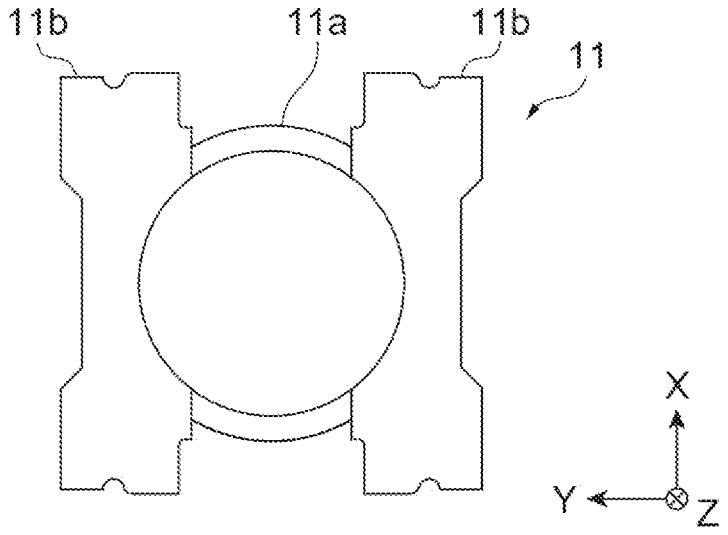
FIG. 4B is a bottom view of the ground contact of the receptacle connector.
Figure 4C:
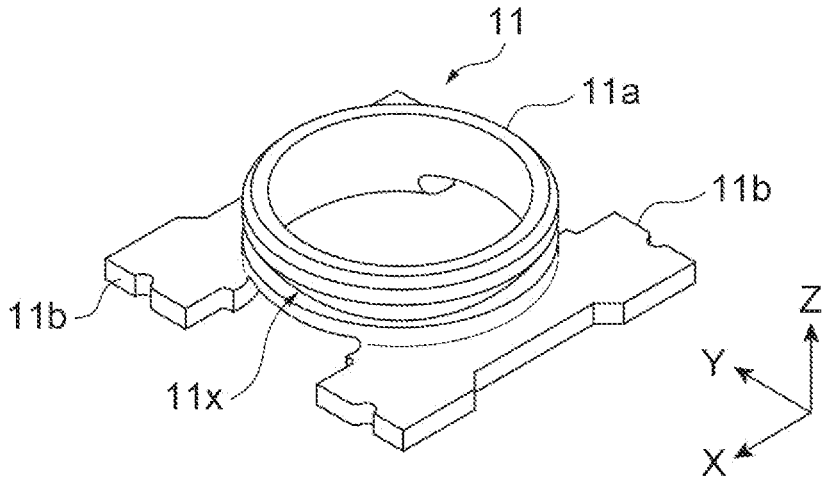
FIG. 4C is a perspective view of the ground contact of the receptacle connector.

The ground contact 11 is a ground contact member that has a tubular shape (in detail, including a fitting portion 11*a* having a tubular shape) and is to be fitted to a ground contact 101 (refer to FIG. 8B) of the plug connector 100. The ground contact 11 is to be electrically connected to the ground contact 101 (refer to FIG. 8B) to form a ground circuit. The ground contact 11 is molded from, for example, a metallic member having a thin plate shape. As illustrated in FIGS. 4A to 4C, the ground contact 11 includes the fitting portion 11*a* and base portions 11*b* and 11*b*.

The fitting portion 11*a* is formed in a cylindrical shape (tubular shape) having the Z direction as an axial direction, and the insulating housing 13 is coaxially accommodated in a tubular hole of the fitting portion 11*a*. An inner peripheral surface of the fitting portion 11*a* is in contact with an outer peripheral surface of the insulating housing 13 except for a region corresponding to a cutout portion 13*x* of the insulating housing 13 (refer to FIG. 3A). A recessed portion 11*x* which is recessed inward in a radial direction (toward a center side of the fitting portion 11*a*) is formed over the entire periphery of an outer peripheral surface of the fitting portion 11*a* (refer to FIG. 3D). The recessed portion 11*x* engages with a protrusion 101*x* (refer to FIG. 8B) formed on an outer periphery of the ground contact 101 of the plug connector 100, so that the fitting portion 11*a* is fitted to the ground contact 101 of the plug connector 100 (details will be described later). The fitting portion 11*a* is provided to stand upright from the base portions 11*b* and 11*b*. The base portions 11*b* and 11*b* are disposed such that the fitting portion 11*a* is placed thereon, and extend in the X direction while facing each other in the Y direction. As illustrated in FIG. 2, the base portions 11*b* and 11*b* are disposed on the board 200 so as to be connected to a ground terminal portion 202 of the board 200.

(Signal Contact)

Figure 5A:
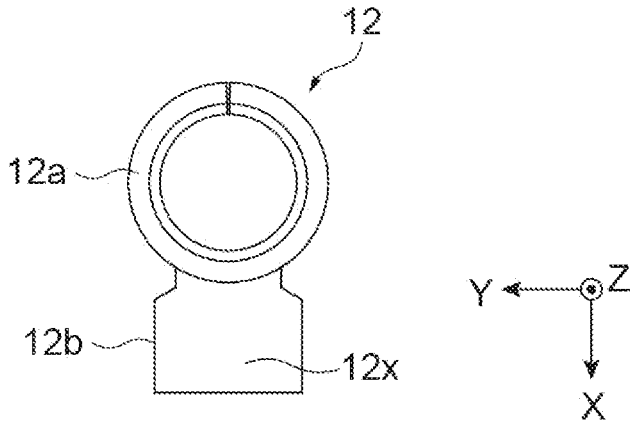
FIG. 5A is a plan view of a signal contact of the receptacle connector.
Figure 5B:
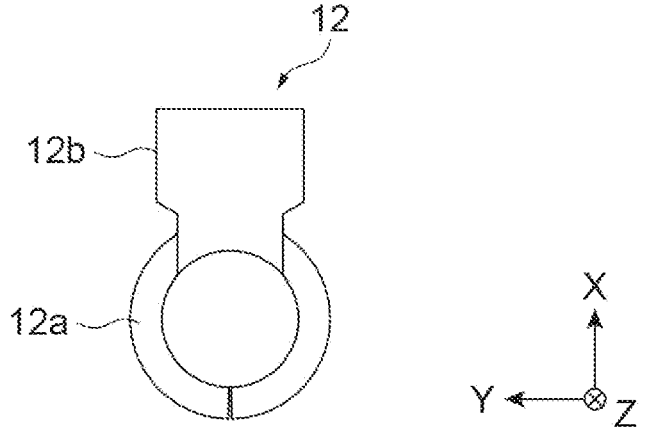
FIG. 5B is a bottom view of the signal contact of the receptacle connector.
Figure 5C:
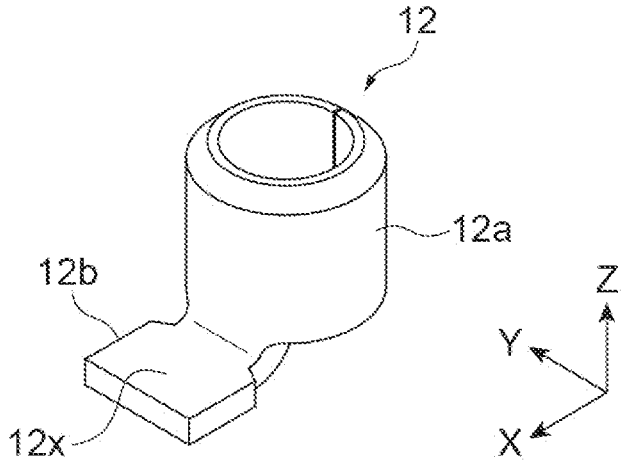
FIG. 5C is a perspective view of the signal contact of the receptacle connector.

The signal contact 12 is to be electrically connected to a signal contact 102 (refer to FIG. 8B) of the plug connector 100. The signal contact 12 is attached to the insulating housing 13. The signal contact 12 is a signal transmission conductor formed from, for example, a metallic member having a thin plate shape. As illustrated in FIGS. 5A to 5C, the signal contact 12 includes a central conductor 12*a* and a board connection portion 12*b*.

The central conductor 12*a* is a conductor that comes into contact with the signal contact 102 (refer to FIG. 8B) of the plug connector 100. The central conductor 12*a* is formed in a cylindrical shape (tubular shape) having the Z direction as an axial direction, and an outer peripheral surface of the central conductor 12*a* comes into contact with the signal contact 102 (refer to FIG. 8B). The central conductor 12*a* is attached to a support portion 13*y* of the insulating housing 13 (refer to FIG. 3C). The board connection portion 12*b* extends so as to lead out from the central conductor 12*a* to be connected to a signal terminal portion 201 (refer to FIG. 2) of the board 200. Namely, the board connection portion 12*b* is continuous with a lower end of the central conductor 12*a*, and extends forward in the X direction (a direction toward the fitting portion 11*a* and a direction away from an inner conductor SC1 of the coaxial cable SC (refer to FIG. 8B)) to be connected to the signal terminal portion 201 (refer to FIG. 2) of the board 200. The shape of the board connection portion 12*b* is not limited, and for example, as illustrated in FIGS. 5A and 5C, the board connection portion 12*b* is a plate-shaped member, and has a substantially rectangular shape in which the length in the X direction is smaller than the length in the Y direction in a plan view.

As illustrated in FIG. 3A, the board connection portion 12*b* is accommodated in a region surrounded by the fitting portion 11*a* of the ground contact 11, and an exposed portion 12*x* which is a tip (front end) portion of the board connection portion 12*b* is exposed to the outside. Being exposed to the outside means, for example, that the exposed portion 12*x* is visible from the outside. More specifically, when viewed in a direction that is the Z direction and is a direction from the plug connector 100 toward the board 200 (first direction), the board connection portion 12*b* is disposed such that the exposed portion 12*x* which is a part of the board connection portion 12*b* is visible. Such exposure of the exposed portion 12*x* is realized by forming the cutout portion 13*x* in the insulating housing 13 (details will be described later). The exposed portion 12*x* is a region of contact with the signal terminal portion 201 on the board connection portion 12*b* (refer to FIG. 2).

(Insulating Housing)

Figure 6A:
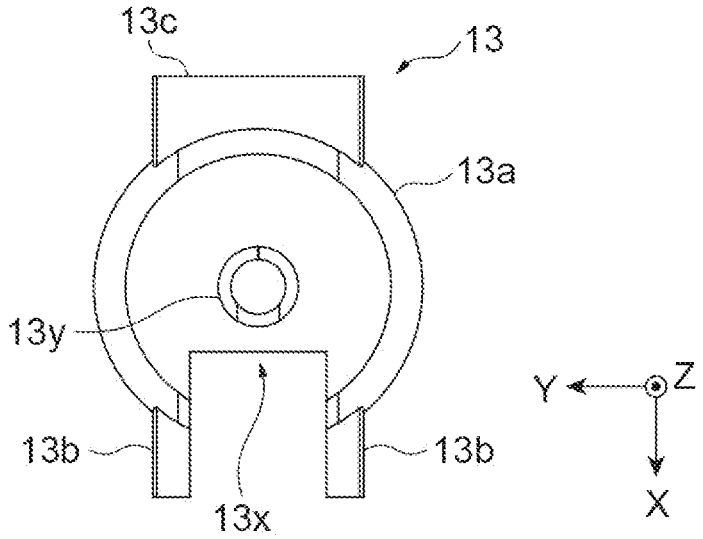
FIG. 6A is a plan view of an insulating housing of the receptacle connector.
Figure 6B:
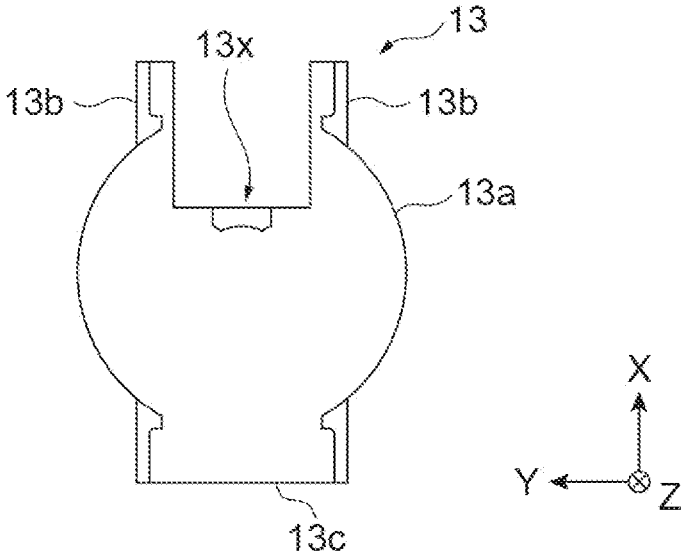
FIG. 6B is a bottom view of the insulating housing of the receptacle connector.
Figure 6C:
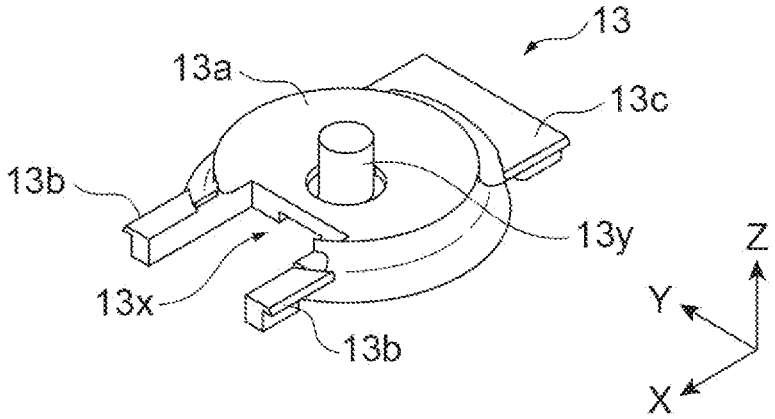
FIG. 6C is a perspective view of the insulating housing of the receptacle connector.

The insulating housing 13 holds the ground contact 11 and the signal contact 12 in an insulated state. Namely, the insulating housing 13 is an insulator that provides insulation between the ground contact 11 and the signal contact 12. As illustrated in FIGS. 6A to 6C, the insulating housing 13 includes a main body portion 13*a*; first extending portions 13*b* and 13*b*; and a second extending portion 13*c*.

The main body portion 13*a* is a member that is formed in a substantially disk shape except for a formation region of the cutout portion 13*x* to be described later and is accommodated inside the fitting portion 11*a*. An outer peripheral surface of the main body portion 13*a* is in contact with the inner peripheral surface of the fitting portion 11*a* except for the formation region of the cutout portion 13*x* (refer to FIG. 3A). The cutout portion 13*x* which exposes the exposed portion 12*x* of the board connection portion 12*b* to the outside is formed in the main body portion 13*a*. Namely, the cutout portion 13*x* is formed such that the exposed portion 12*x* which is the region of contact with the signal terminal portion 201 on the board connection portion 12*b* is exposed to the outside. The length (width) in the Y direction of the cutout portion 13*x* is longer than the lengths (widths) in the Y direction of the exposed portion 12*x* and the signal terminal portion 201 such that the exposed portion 12*x* and a region of contact with the exposed portion 12*x* on the signal terminal portion 201 coming into contact with the exposed portion 12*x* are exposed (visible) (refer to FIG. 3A). The cutout portion 13*x* may be formed only in a region related to the exposure of the exposed portion 12*x* on the main body portion 13*a*. For this reason, as illustrated in FIG. 3A, even in a region on the main body portion 13*a*, of which the position in the X direction is the same as the exposed portion 12*x* or is in front of the exposed portion 12*x*, a part of the insulating housing 13 is not cut out in regions located outside both end portions in the Y direction of the exposed portion 12*x* in the Y direction.

As illustrated in FIGS. 6A to 6C, the main body portion 13*a* includes the support portion 13*y*, to which the central conductor 12*a* is attached, in a central portion of the main body portion 13*a*. The support portion 13*y* is a columnar member that is provided in the central portion of the main body portion 13*a* and extends in the Z direction. The first extending portions 13*b* and 13*b* are continuous with a front end in the X direction of the main body portion 13*a*, and extend forward in the X direction while facing each other in the Y direction. The first extending portions 13*b* and 13*b* extend forward in the X direction along inner edges of the base portions 11*b* and 11*b* of the ground contact 101, respectively (refer to FIG. 3C). The second extending portion 13*c* is continuous with a rear end in the X direction of the main body portion 13*a*, and extends rearward in the X direction along the base portions 11*b* and 11*b* to be interposed between the base portions 11*b* and 11*b* (refer to FIG. 3A).

(Process of Producing Receptacle Connector)

Next, a process of producing the receptacle connector 10 (molding process) will be described with reference to FIGS. 7A to 7F.

Figure 7A:
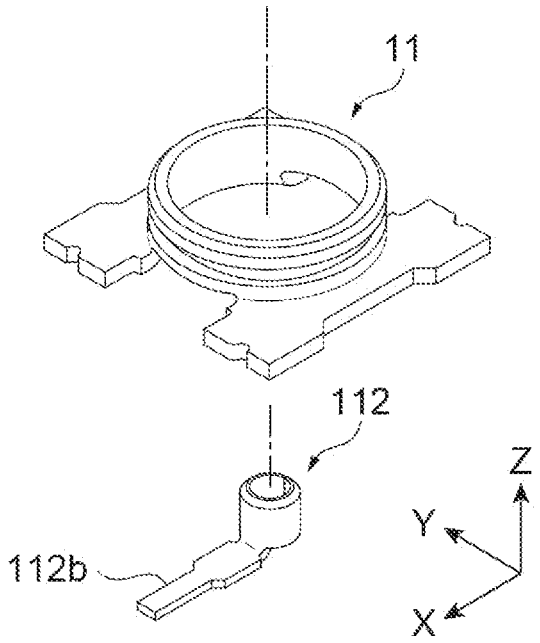
FIG. 7A is a first perspective view illustrating a process of producing the receptacle connector in order.
Figure 7B:
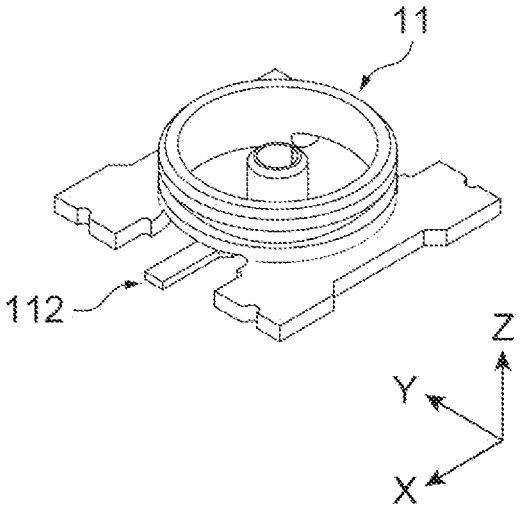
FIG. 7B is a second perspective view illustrating the process of producing the receptacle connector in order.
Figure 7C:
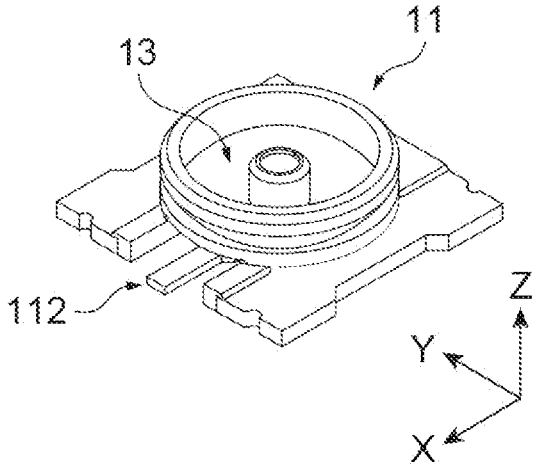
FIG. 7C is a third perspective view illustrating the process of producing the receptacle connector in order.
Figure 7D:
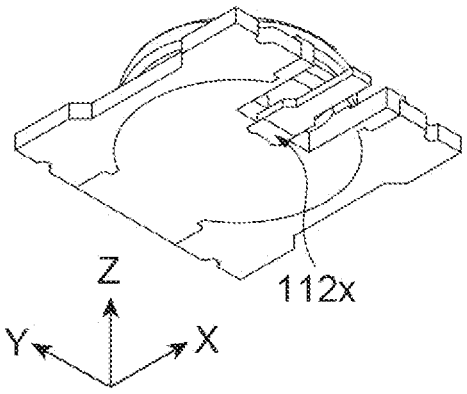
FIG. 7D is a fourth perspective view illustrating the process of producing the receptacle connector in order.
Figure 7E:
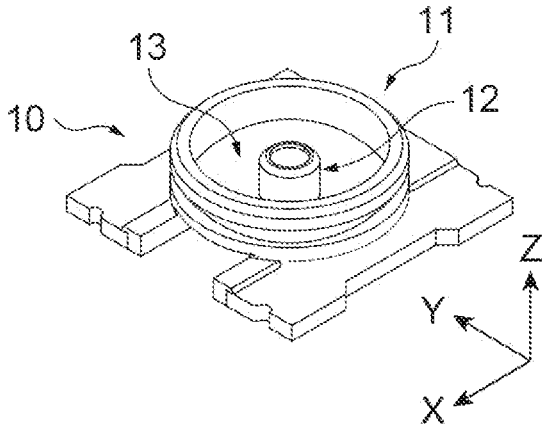
FIG. 7E is a fifth perspective view illustrating the process of producing the receptacle connector in order.
Figure 7F:
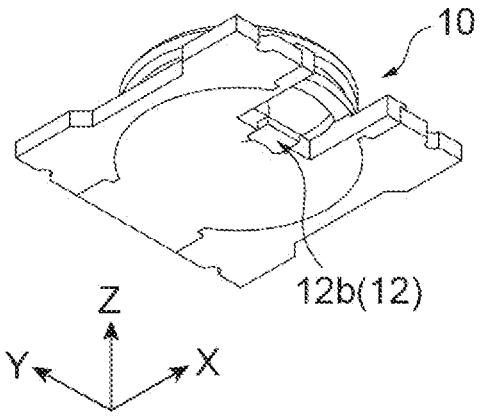
FIG. 7F is a sixth perspective view illustrating the process of producing the receptacle connector in order.

In the process of producing the receptacle connector 10, initially, as illustrated in FIG. 7A, the ground contact 11 and a signal contact member 112 which are components to be installed in a mold (not illustrated) are prepared. The signal contact member 112 is a member formed into the signal contact 12 by a process to be described later, and includes an extending portion 112*b* that is made longer than the board connection portion 12*b*. Then, as illustrated in FIG. 7B, in a state where the ground contact 11 and the signal contact member 112 are installed in the mold (not illustrated), a resin (housing material) is injected into the mold (not illustrated). FIG. 7C illustrates a state where the resin is injected into the mold and the insert molding is completed, namely, a state where the insulating housing 13 is formed. As illustrated in FIG. 7D, a cut line 112*x* is formed in the signal contact member 112. The signal contact 12 including the board connection portion 12*b* is formed as illustrated in FIG. 7F by cutting off a region in front of the cut line 112*x* at the cut line 112*x* as illustrated in FIG. 7E. The receptacle connector 10 is produced by the above-described process. Incidentally, the production process which has been described is one example, and the receptacle connector 10 may be produced by other production processes.

[Connector Device (State of Fitting of Receptacle Connector and Plug Connector)]

Figure 8A:
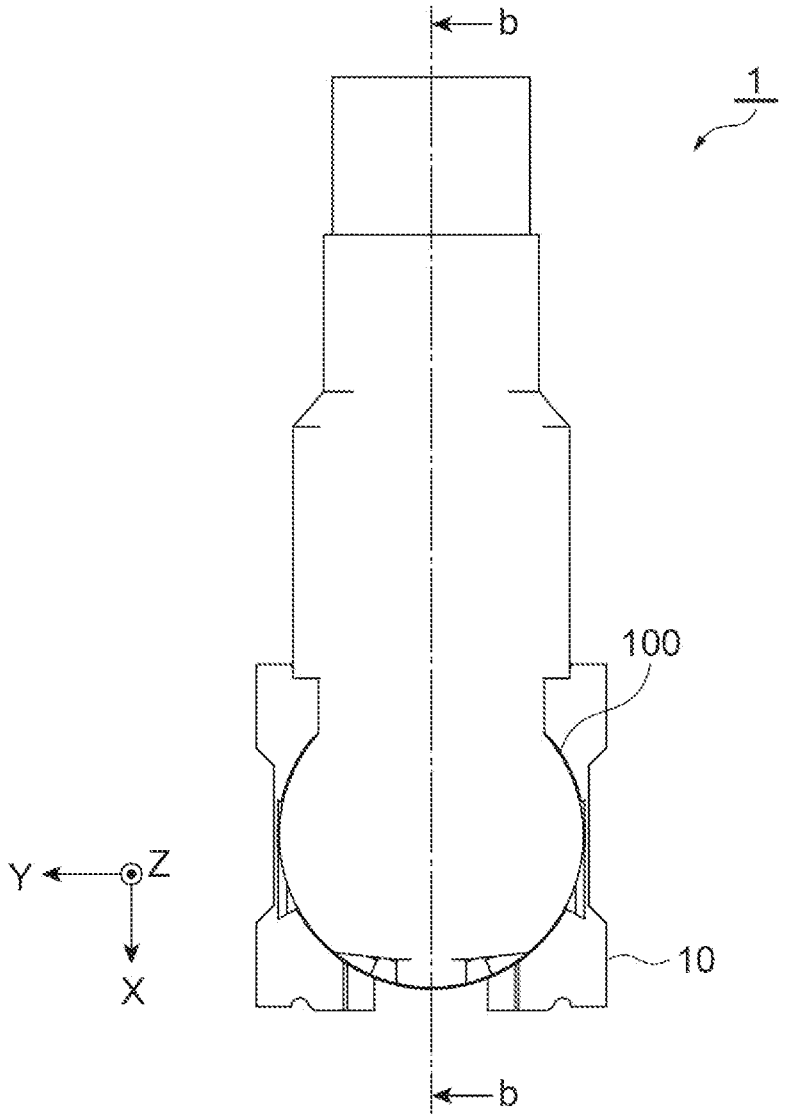
FIG. 8A is a plan view illustrating the state of fitting of a plug connector and the receptacle connector.

Next, the connector device 1 in which the receptacle connector 10 and the plug connector 100 are fitted to each other will be described in detail with reference to FIGS. 8A and 8B.

Figure 8B:
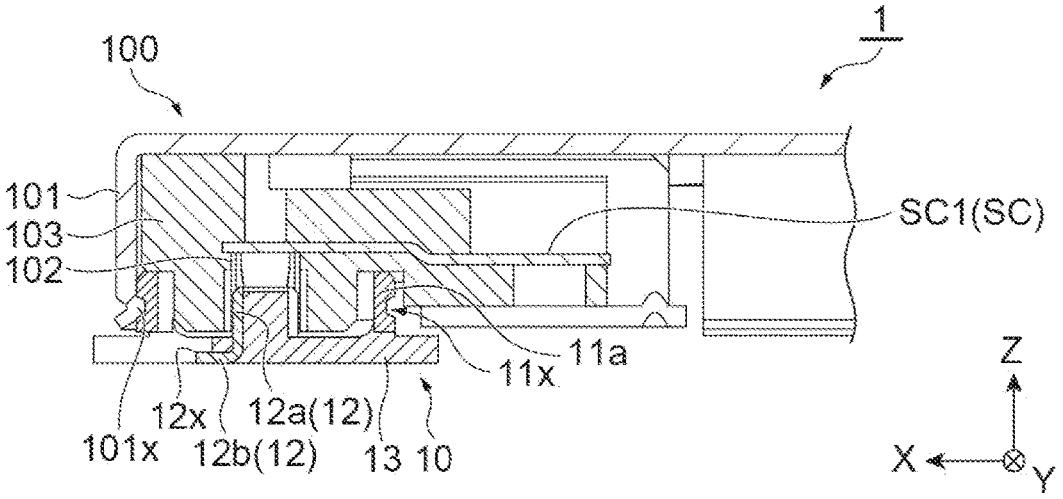
FIG. 8B is a cross-sectional view taken along line b-b in FIG. 8A.

Incidentally, as illustrated in FIG. 8B, the plug connector 100 includes the ground contact 101 (third contact); the signal contact 102 (fourth contact); and an insulating housing 103 (second insulating housing). The ground contact 101 is a cylindrical contact member to be fitted to the ground contact 11. The ground contact 101 is connected to an outer conductor of the coaxial cable SC. The protrusion 101*x* which protrudes inward in the radial direction (toward a center side of the cylindrical shape of the ground contact 101) is provided over the entire periphery on a lower end side of the ground contact 101. The signal contact 102 is electrically connected to the signal contact 12. The signal contact 102 is attached to the inside of the insulating housing 103, is connected to the inner conductor SC1 of the coaxial cable SC, and is connected to the central conductor 12*a* of the signal contact 12 of the receptacle connector 10. The insulating housing 103 is formed in a cylindrical shape, and holds the ground contact 101 and the signal contact 102 in an insulated state. An outer peripheral surface of the insulating housing 103 is in contact with an inner peripheral surface of the ground contact 101.

As illustrated in FIG. 8B, the receptacle connector 10 and the plug connector 100 are fitted to each other by the recessed portion 11*x* of the fitting portion 11*a* of the receptacle connector 10. In the state of fitting, the signal contact 102 of the plug connector 100 is in contact with the central conductor 12*a* of the receptacle connector 10. As described above, the signal contact 102 connected to the inner conductor SC1 of the coaxial cable SC and the central conductor 12*a* connected to the signal terminal portion 201 (refer to FIG. 2) of the board 200 via the board connection portion 12*b* come into contact with each other to form a signal transmission circuit of the connector device 1. In addition, in the state of fitting, the ground contact 101 of the plug connector 100 is in contact with the fitting portion 11*a* of the receptacle connector 10. As described above, the ground contact 101 connected to the outer conductor of the coaxial cable SC and the fitting portion 11*a* connected to the ground terminal portion 202 (refer to FIG. 2) of the board 200 via the base portions 11*b* and 11*b* come into contact with each other to form a ground circuit of the connector device 1.

Then, in the connector device 1, in the state of fitting, as illustrated in FIG. 8B, the board connection portion 12*b* is accommodated in a region surrounded by the ground contact 101 of the plug connector 100, and in the state of non-fitting, as illustrated in FIG. 3A, the exposed portion 12*x* of the board connection portion 12*b* is exposed to the outside (namely, disposed so as to be visible).

Technical Effects

Next, effects of the receptacle connector 10 and the connector device 1 described above will be described.

Figure 9A:
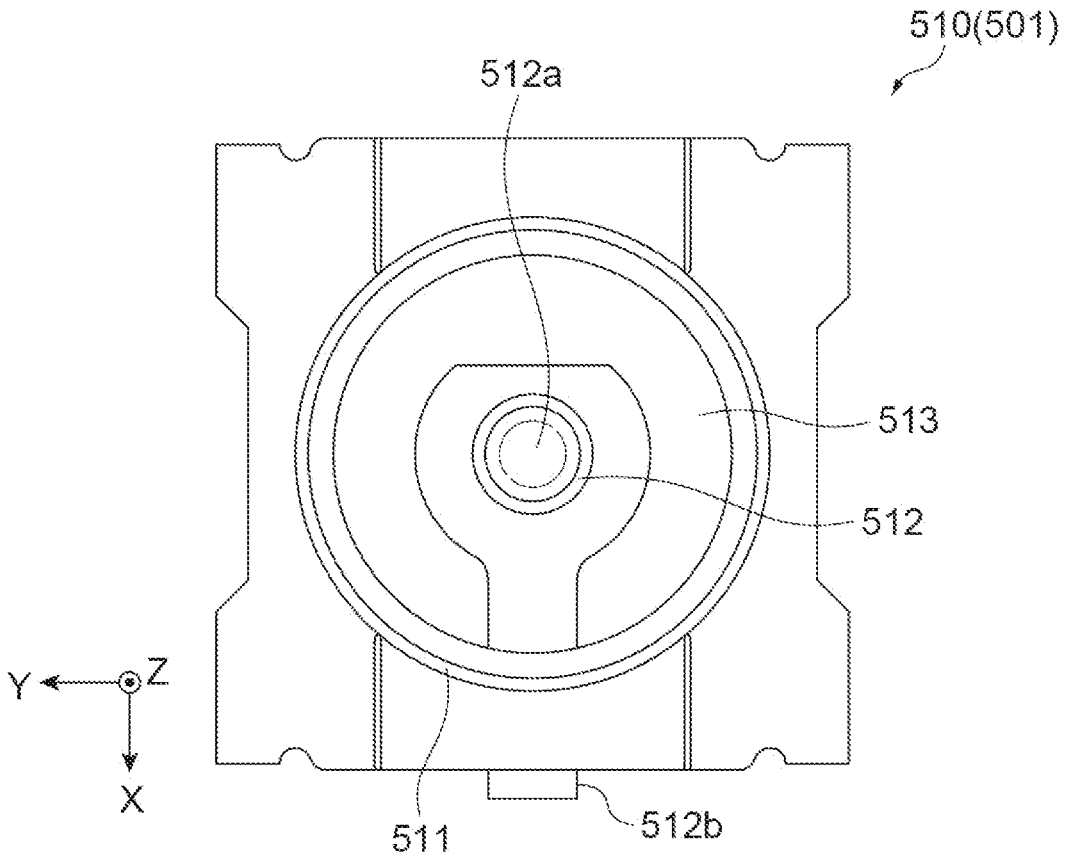
FIG. 9A is a plan view of a receptacle connector included in a connector device according to a comparative example.
Figure 9B:
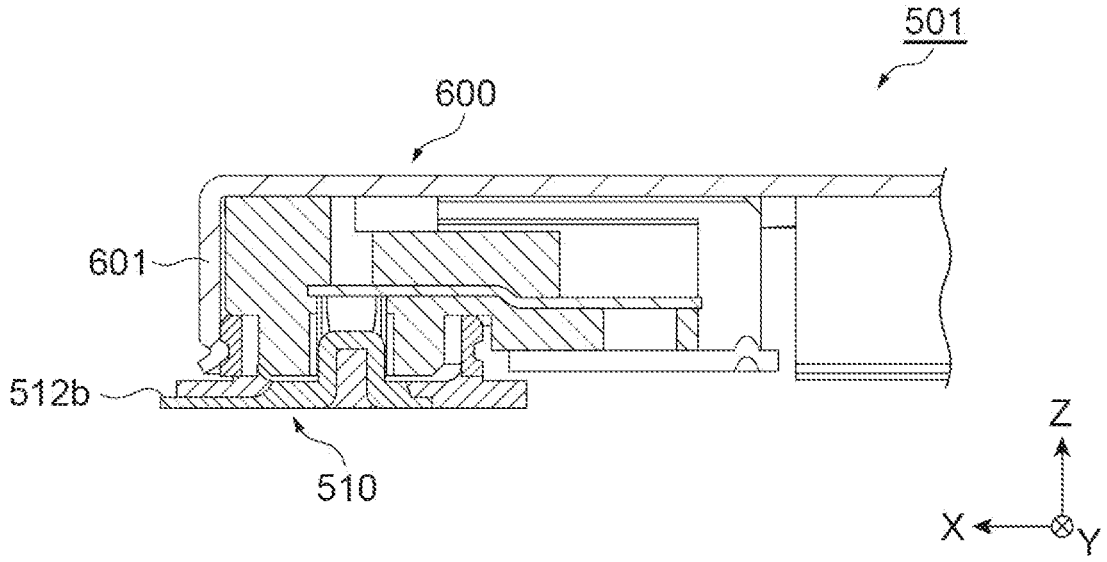
FIG. 9B is a cross-sectional view of the connector device according to the comparative example.

Initially, a connector device 501 according to a comparative example will be described with reference to FIGS. 9A and 9B. Similarly to the connector device 1 of the present example, the connector device 501 is a connector device that electrically connects a signal transmission member and an electrical circuit of a board. As illustrated in FIG. 9A, a receptacle connector 510 of the connector device 501 includes a ground contact 511; a signal contact 512; and an insulating housing 513. Then, the signal contact 512 includes a central conductor 512*a* and a board connection portion 512*b* that leads outward from the central conductor 512*a*. Here, in the connector device 501 according to the comparative example, for example, when the receptacle connector 510 is mounted on the board, in order to improve visibility (ease to observe) of the board connection portion 512*b* connected to a signal terminal portion of the board, the board connection portion 512*b* leads outward from the ground contact 511. Namely, a region between the ground contact 511 and the signal contact 512 is filled with the insulating housing 513, and meanwhile, in order to improve visibility of the board connection portion 512*b*, the board connection portion 512*b* leads outward from the ground contact 511 (refer to FIG. 9A). It can considered that in the connector device 501 described above, as illustrated in FIG. 9B, in a state where the receptacle connector 510 and a plug connector 600 are fitted to each other, the board connection portion 512*b* is configured to exceed a region, which is surrounded by a ground contact 601 of the plug connector 600, to extend further outward. In this case, a region of proximity between the ground contact 601 of the plug connector 600 and the board connection portion 512*b* of the receptacle connector 510 is increased, so that electromagnetic coupling between the ground contact 601 and the board connection portion 512*b* is likely to occur. Therefore, the insertion loss between the plug connector 600 and the receptacle connector 510 is increased.

In order to solve the problem of the connector device 501 according to the comparative example, the receptacle connector 10 of the connector device 1 of the present example has the following configuration. Namely, as illustrated in FIG. 3A, the receptacle connector 10 is an electrical connector that is mounted on the board 200, and includes the ground contact 11 including the fitting portion 11*a* that has a tubular shape and is to be fitted to the ground contact 101 of the plug connector 100; the signal contact 12 that is to be electrically connected to the signal contact 102 of the plug connector 100; and the insulating housing 13 that holds the ground contact 11 and the signal contact 12 in an insulated state. The signal contact 12 includes the central conductor 12*a* that comes into contact with the signal contact 102 of the plug connector 100, and the board connection portion 12*b* that extends so as to lead out from the central conductor 12*a* to be connected to the signal terminal portion 201 of the board 200. The board connection portion 12*b* is accommodated in the region surrounded by the fitting portion 11*a*, and at least a part (specifically, the exposed portion 12*x*) of the board connection portion 12*b* is exposed to the outside.

In the receptacle connector 10 described above, the board connection portion 12*b* which extends so as to lead out from the central conductor 12*a* to be connected to the signal terminal portion 201 of the board 200 is accommodated in the region surrounded by the fitting portion 11*a* (inside the fitting portion 11*a*) that has a tubular shape and is to be fitted to the ground contact 101 of the plug connector 100. As illustrated in FIG. 8B, the ground contact 101 of the plug connector 100 is disposed outside the fitting portion 11*a*. For this reason, in a state where the receptacle connector 10 is fitted to the plug connector 100, the board connection portion 12*b* accommodated inside the fitting portion 11*a* is disposed at a position separated from the ground contact 101 of the plug connector 100. Therefore, a configuration is realized in which electromagnetic coupling between the ground contact 101 of the plug connector 100 and the board connection portion 12*b* is unlikely to occur, so that the insertion loss between the receptacle connector 10 and the plug connector 100 can be suppressed. Here, as described above, in the connector device 501 according to the comparative example, in order to ensure visibility (ease to observe) of the board connection portion 512*b*, the board connection portion 512*b* leads outward from the ground contact 511 (refer to FIG. 9A). As in the present example, in the configuration in which the board connection portion 12*b* is accommodated inside the fitting portion 11*a*, since the insulating housing 13 is provided inside the fitting portion 11*a*, the visibility of the board connection portion 12*b* can be a problem. In this respect, the receptacle connector 10 according to the present example is configured such that not merely is the board connection portion 12*b* accommodated inside the fitting portion 11*a*, but also a part of the board connection portion 12*b* is exposed to the outside as the exposed portion 12*x*. Accordingly, even when the configuration is adopted in which the board connection portion 12*b* is accommodated in the region surrounded by the fitting portion 11*a* (namely, the lead-out length of the board connection portion 12*b* is short), the position of the board connection portion 12*b* can be easily observed.

In the receptacle connector 10, when viewed in the first direction that is the direction of fitting to the plug connector 100 and is the direction from the plug connector 100 toward the board 200, the board connection portion 12*b* is disposed such that at least a part of the board connection portion 12*b* is visible. Accordingly, when the receptacle connector 10 is mounted on the board 200, when the plug connector 100 is fitted to the receptacle connector 10, and the like, the position of the board connection portion 12*b* can be easily and reliably observed.

In the receptacle connector 10, the cutout portion 13*x* which exposes at least a part (specifically, the exposed portion 12*x*) of the board connection portion 12*b* to the outside is formed in the insulating housing 13. Since such a configuration is adopted, while the insulating housing 13 provides reliable insulation between the ground contact 11 and the signal contact 12, only a portion required to expose the board connection portion 12*b* is cut out in the main body portion 13*a* of the insulating housing 13 to be able to reliably expose the exposed portion 12*x*.

In the receptacle connector 10, the cutout portion 13*x* is formed such that the region of contact with the signal terminal portion 201 on the board connection portion 12*b* is exposed to the outside. Accordingly, the location of contact between the board connection portion 12*b* and the signal terminal portion 201 is reliably visible.

Figure 10A:
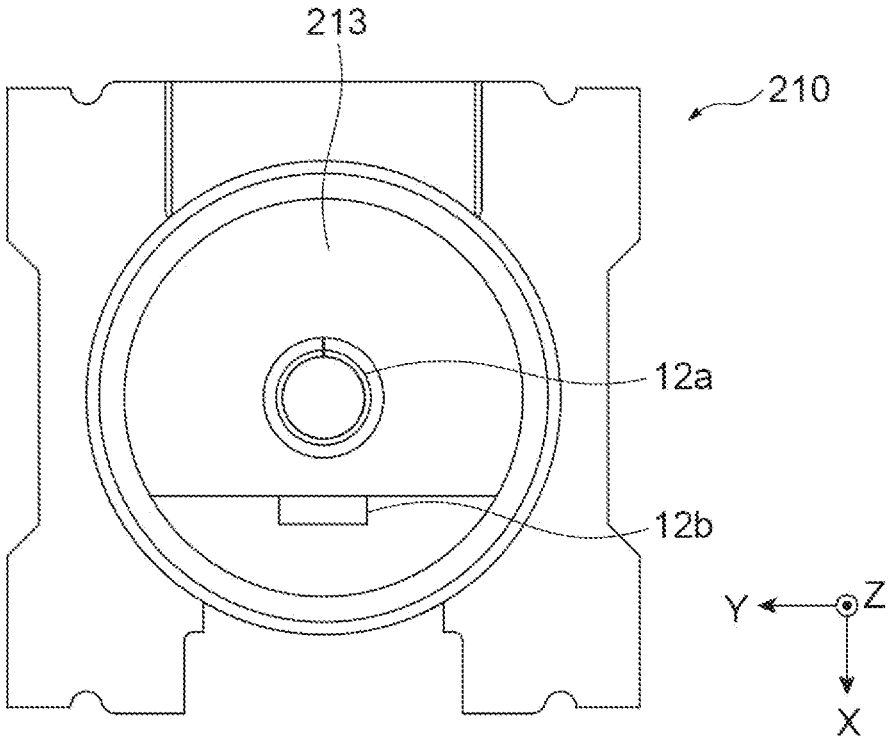
FIG. 10A is a plan view illustrating a receptacle connector according to a modification example.
Figure 10B:
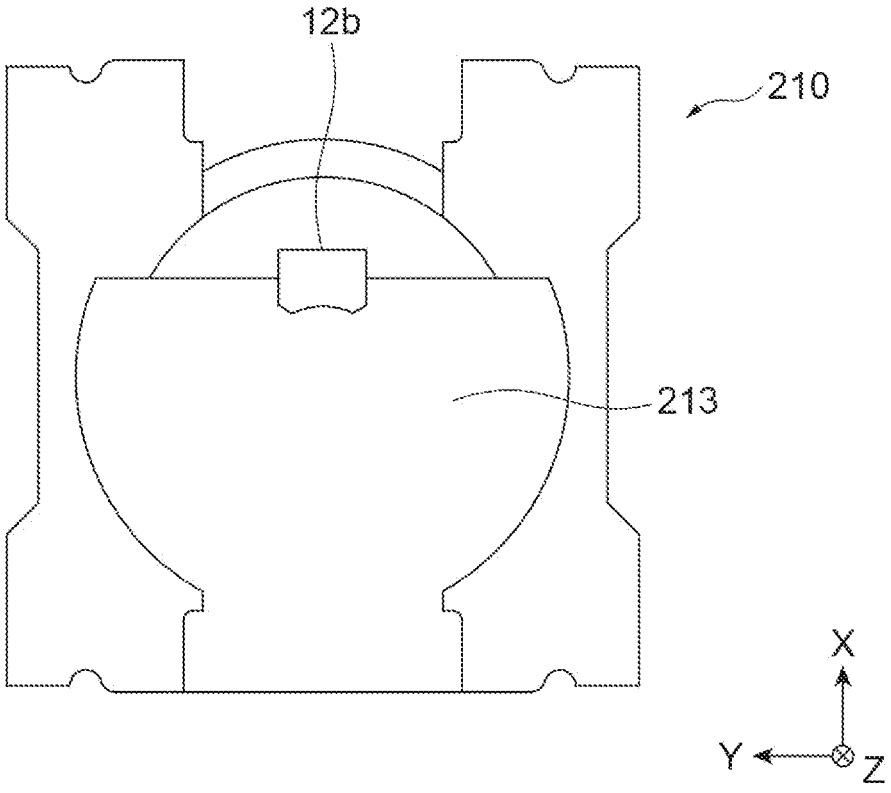
FIG. 10B is a bottom view illustrating the receptacle connector according to the modification example.

The present example has been described above; however, the present disclosure is not limited to the example. For example, an example has been described in which the cutout is formed in the insulating housing of the receptacle connector, as a configuration for exposing the board connection portion; however, the configuration for exposing the board connection portion is not limited thereto. A receptacle connector 210 illustrated in FIGS. 10A and 10B includes an insulating housing 213. The insulating housing 213 is provided only in a region that is closer to the central conductor 12*a* (namely, the rear in the X direction) than a tip (front end) of the board connection portion 12*b* in an extending direction of the board connection portion 12*b*, namely, in the X direction. Even when such a configuration is adopted, similarly to when the cutout is formed, a part of the board connection portion 12*b* can be properly exposed. In addition, in such a configuration, for example, as compared to when the cutout is formed in the insulating housing, the configuration of the insulating housing 213, which allows a part of the board connection portion 12*b* to be exposed, can be further simplified, and the ease to produce the insulating housing 213 can be further improved.

Figure 11A:
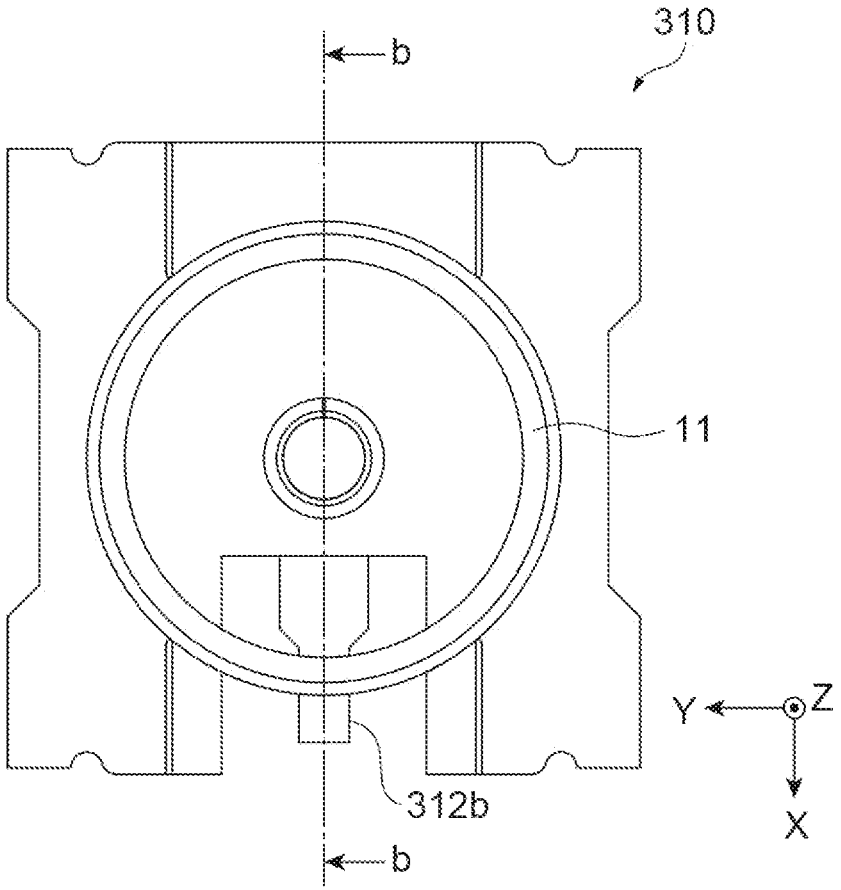
FIG. 11A is a plan view illustrating a receptacle connector according to a modification example.
Figure 11B:
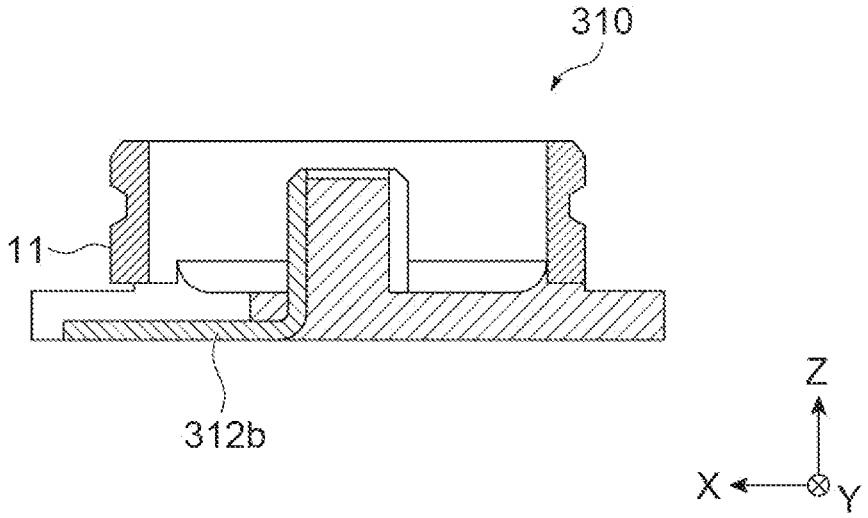
FIG. 11B is a cross-sectional view taken along line b-b in FIG. 11A.
Figure 12A:
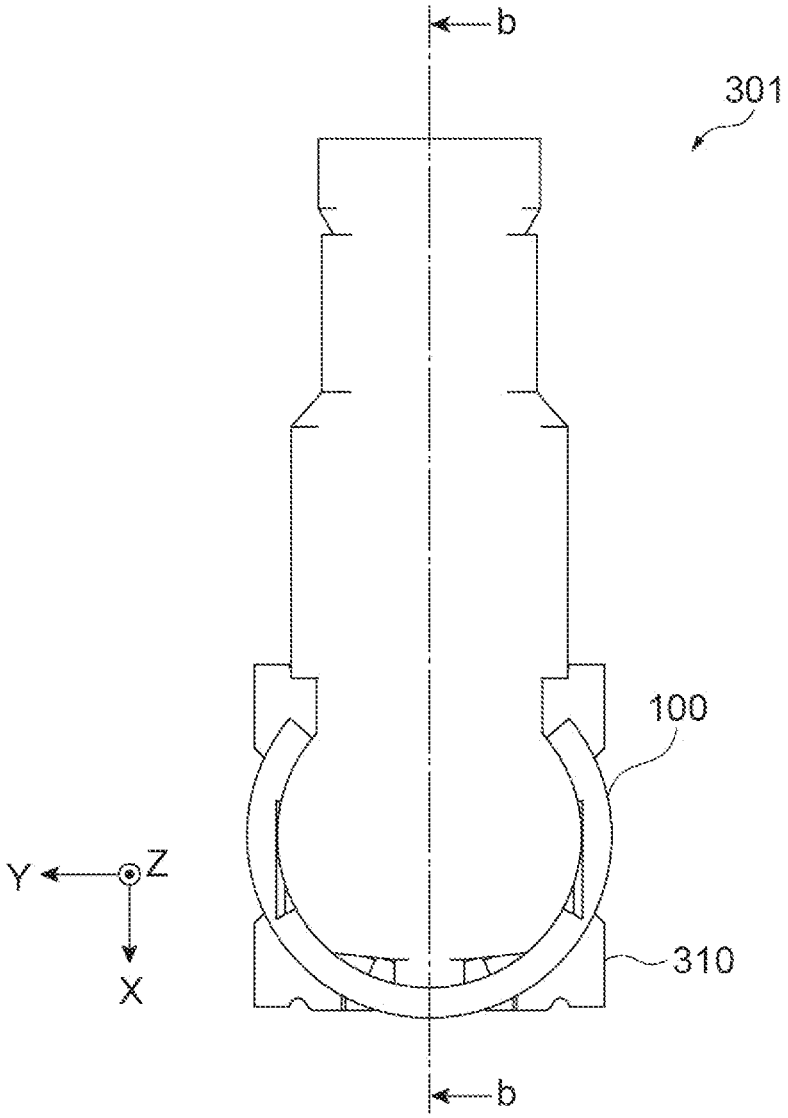
FIG. 12A is a plan view illustrating a connector device according to a modification example.
Figure 12B:
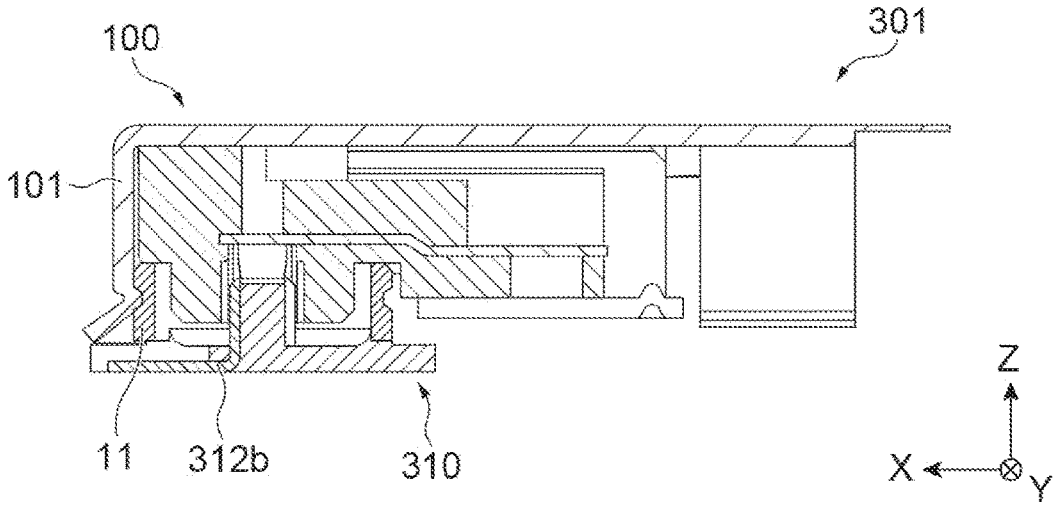
FIG. 12B is a cross-sectional view taken along line b-b in FIG. 12A.

In addition, the configuration has been described in which the board connection portion is accommodated in the region surrounded by the ground contact of the receptacle connector; however, the present disclosure is not limited thereto. A receptacle connector 310 illustrated in FIGS. 11A and 11B includes a board connection portion 312*b* of the signal contact. The entirety of the board connection portion 312*b* is not accommodated in the region surrounded by the ground contact 11, but a part of the board connection portion 312*b* extends to the outside of the ground contact 11. Even when such a configuration is adopted, as in a connector device 301 illustrated in FIGS. 12A and 12B, in the state of fitting, the board connection portion 312*b* is accommodated in the region surrounded by the ground contact 101 of the plug connector 100 (does not extend to the outside of the ground contact 101), so that an increase in region of proximity between the ground contact 101 and the board connection portion 312*b* of the receptacle connector 310 can be suppressed. Therefore, the insertion loss between the receptacle connector 310 and the plug connector 100 can be suppressed.

The invention claimed is:

1. An electrical connector mounted on a board, the connector comprising:

a first contact configured to have a tubular shape and be fitted to a ground contact of a mating connector;

a second contact configured to be electrically connected to a signal contact of the mating connector; and a first insulating housing configured to hold the first contact and the second contact in an insulated state, wherein the second contact comprises:

a central conductor configured to come into contact with the signal contact of the mating connector; and a board connection portion configured to extend so as to lead out from the central conductor to be connected to a terminal portion of the board, and wherein the board connection portion is entirely accommodated in a region surrounded by the first contact, and wherein the board connection portion comprises an exposed portion which is at least a part of the board connection portion and is visible when viewed in a Z direction which is a direction of fitting the electrical connector to the mating connector and is a direction from the mating connector toward the board.

2. The electrical connector according to claim 1, wherein the exposed portion is a tip portion of the board connection portion in an X direction, and wherein the X direction is an extending direction of the board connection portion from the central conductor toward the terminal portion of the board.

3. The electrical connector according to claim 1, wherein the first insulating housing comprises a cutout portion which exposes the exposed portion to the outside.

4. The electrical connector according to claim 3, wherein the cutout portion is formed such that a region of contact with the terminal portion on the board connection portion is exposed to the outside.

5. The electrical connector according to claim 3, wherein the first insulating housing is not cut out in a first region that is closer to the central conductor than the exposed portion of the board connection portion in an X direction, wherein the X direction is an extending direction of the board connection portion from the central conductor toward the terminal portion of the board, and wherein the first insulating housing is cut out in a second region that is not closer to the central conductor than the exposed portion of the board connection portion in the X direction.

6. The electrical connector according to claim 5, wherein at least a part of the first insulating housing is not cut out in a region in the second region located outside both end portions of the exposed portion in a Y direction, and wherein the Y direction is a direction crossing the X direction.

7. The electrical connector according to claim 3, wherein a length in a Y direction of the cutout portion is longer than a length in the Y direction of the exposed portion, and wherein the Y direction is a direction crossing an X direction and the X direction is an extending direction of the board connection portion from the central conductor toward the terminal portion of the board.

8. The electrical connector according to claim 3, wherein a length in a Y direction of the cutout portion is longer than a length in the Y direction of the terminal portion of the board, and wherein the Y direction is a direction crossing an X direction and the X direction is an extending direction of the board connection portion from the central conductor toward the terminal portion of the board.

9. The electrical connector according to claim 1, wherein the first insulating housing is provided at least in a first region that is closer to the central conductor than the exposed portion of the board connection portion in an X direction, wherein the X direction is an extending direction of the board connection portion from the central conductor toward the terminal portion of the board, and wherein the first insulating housing is not provided in a second region that is not closer to the central conductor than the exposed portion of the board connection portion in the X direction.

10. The electrical connector according to claim 9, wherein the first insulating housing has a circular shape including a major segment.

11. The electrical connector according to claim 9, wherein the second region has a circular shape including a minor segment.

12. The electrical connector according to claim 1, wherein the board connection portion is entirely accommodated in a region surrounded by an inner peripheral surface of the first contact.

13. The electrical connector according to claim 1,
wherein the board connection portion does not extend outside of the first contact.

14. A connector device comprising:
a first connector mounted on a board; and
a second connector configured to be connected to a signal transmission member and be fitted to the first connector,
wherein the first connector comprises:
a first contact configured to be a ground contact having a tubular shape;
a second contact configured to be a signal contact; and
a first insulating housing configured to hold the first contact and the second contact in an insulated state,
wherein the second connector comprises:
a third contact configured to have a tubular shape and be fitted to the first contact;
a fourth contact configured to be electrically connected to the second contact; and
a second insulating housing configured to hold the third contact and the fourth contact in an insulated state,
wherein the second contact comprises:
a central conductor configured to come into contact with the fourth contact; and
a board connection portion configured to extend so as to lead out from the central conductor to be connected to a terminal portion of the board,
wherein in a state where the first connector and the second connector are fitted to each other, the board connection portion is entirely accommodated in a region surrounded by the third contact of the second connector, and
wherein in a state where the first connector and the second connector are not fitted to each other, at least a part of the board connection portion is visible when viewed in a Z direction which is a direction of fitting the first connector to the second connector and is a direction from the second connector toward the board.

15. The connector device according to claim 14,
wherein in a state where the first connector and the second connector are fitted to each other, the board connection portion is entirely accommodated in a region surrounded by an inner peripheral surface of the third contact of the second connector.

16. The connector device according to claim 14,
wherein the board connection portion does not extend outside of the third contact.

17. An electrical connector configured to be connected to a signal transmission member and fitted to a mating connector mounted on a board, the electrical connector comprising:
a third contact configured to have a tubular shape and be fitted to a first contact of the mating connector;
a fourth contact configured to be electrically connected to a second contact of the mating connector; and
a second insulating housing configured to hold the third contact and the fourth contact in an insulated state,
wherein in a state where the electrical connector and the mating connector are fitted to each other, a board connection portion of the mating connector is entirely accommodated in a region surrounded by the third contact of the electrical connector,
wherein the mating connector comprises the board connection portion configured to extend so as to lead out from a central conductor of the mating connector to be connected to a terminal portion of the board, and
wherein the board connection portion comprises an exposed portion which is at least a part of the board connection portion and is visible when viewed in a Z direction which is a direction of fitting the mating connector to the electrical connector and is a direction from the electrical connector toward the board.

18. The electrical connector according to claim 17,
wherein in a state where the electrical connector and the mating connector are fitted to each other, a board connection portion of the mating connector is entirely accommodated in a region surrounded by an inner peripheral surface of the third contact of the electrical connector.

19. The electrical connector according to claim 17,
wherein the board connection portion does not extend outside of the third contact.

* * * * *